US005111980A

United States Patent [19]

Amsler

[11] Patent Number: 5,111,980

[45] Date of Patent: May 12, 1992

[54] APPARATUS FOR MOUNTING A CASTING PIPE TO AN OUTLET OF A METALLURGICAL VESSEL

[76] Inventor: Heinrich Amsler, Chriesbaumhof 12,, CH-6404 Greppen, Switzerland

[21] Appl. No.: 611,093

[22] Filed: Nov. 8, 1990

[30] Foreign Application Priority Data

Dec. 6, 1989 [CH] Switzerland ..... 04370/89-0

[51] Int. Cl.[5] ..... B22D 41/24

[52] U.S. Cl. ..... 222/600; 164/437

[58] Field of Search ..... 164/337, 437; 222/597, 222/600

[56] References Cited

U.S. PATENT DOCUMENTS

| | | | |
|---|---|---|---|
| 3,764,042 | 10/1973 | Shapland et al. | 222/600 |
| 4,079,869 | 3/1978 | Meier et al. . | |
| 4,168,790 | 9/1979 | Lothmann et al. | 222/600 |
| 4,848,604 | 7/1989 | Fricker | 222/600 |

FOREIGN PATENT DOCUMENTS

| | | | |
|---|---|---|---|
| 2342876 | 3/1974 | Fed. Rep. of Germany | 164/337 |
| 2363824 | 6/1975 | Fed. Rep. of Germany | 164/337 |
| 41665 | 9/1986 | Japan | 164/437 |
| 207567 | 9/1987 | Japan | 164/437 |
| 1440916 | 7/1973 | United Kingdom . | |
| 2164592 | 3/1986 | United Kingdom | 164/437 |

*Primary Examiner*—Richard K. Seidel

[57] ABSTRACT

An apparatus mounts a casting pipe having therethrough a discharge opening to an outlet of a metallurgical vessel to enable discharge of molten metal from the vessel through an opening of the outlet and through the discharge opening of the casting pipe. The apparatus includes a support member supporting at least one casting pipe. The support member is mounted adjacent the outlet of the vessel. A closing member is mounted on the support member in a manner such that a closing surface of the closing member extends laterally of an end surface of the casting pipe. The support member, and thus the casting pipe and closing member, are adjustably movable relative to the outlet in first opposite directions parallel to a longitudinal axis of the outlet opening and in second opposite directions transverse to the first opposite directions and transverse to the longitudinal axis.

19 Claims, 2 Drawing Sheets

APPARATUS FOR MOUNTING A CASTING PIPE TO AN OUTLET OF A METALLURGICAL VESSEL

BACKGROUND OF THE INVENTION

The present invention relates to an apparatus for mounting a casting pipe having therethrough a discharge opening to an outlet of a metallurgical vessel to enable discharge of molten metal from the vessel through an opening of the output in through the discharge opening of the casting pipe. More particularly, the present invention relates to such an apparatus of the type including a support member, for example a bearing arm, that supports or receives at least one casting pipe and that is mounted on or relative to the metallurgical vessel so as to be adjustable both in opposite directions parallel to the axis of the outlet opening and in opposite directions transverse to such axis.

Disclosed in German DE-OS 25 57 726 is an apparatus having two holders or arms each of which receives a casting pipe and that is mounted on a metallurgical vessel. Each casting pipe is pivoted around a vertical axis below the vessel outlet by means of the respective holder that is in the form of a swivel arm and is then forced upwardly against the vessel outlet by means of an adjusting device. In this apparatus a slide enclosure unit or slide gate is mounted between the vessel and the casting pipe. Instead of such slide gate, a stopper or a so-called free-running nozzle could be employed. Even with such a slide gate or with a stopper, it is known that for various reasons it can happen that while metal is being discharged, the intended closure member, such as a slide plate of the slide gate or the stopper, no longer can be operated to close off discharge of the molten metal. When this happens, the molten metal flows in an uncontrolled manner, and the result can be significant damage to the installation and danger to operating personnel.

SUMMARY OF THE INVENTION

With the above discussion in mind, it is an object of the present invention to provide an apparatus of this type wherein it is possible to overcome the above and other prior art disadvantages.

It is a further object of the present invention to provide such an apparatus whereby it always is possible to close and shut-off the discharge of molten metal, for example during an emergency situation, in a simple and reliable manner.

These objects are achieved in accordance with the present invention by provision of a support member having means for supporting at least one casting pipe. The support member is mounted at a position adjacent the outlet of the metallurgical vessel. The support member has mounted thereon a closing member having a closing surface at a position to extend laterally of, preferably coplanar with, an end surface of the casting pipe that is to abut in sealing manner the vessel outlet. The support member is adjustably movable, and thus also the casting pipe supported thereby and the closing member, relative to the vessel outlet in first opposite directions to be parallel to a longitudinal axis of the outlet opening and in second opposite directions transverse to such first opposite directions and to be transverse to such longitudinal axis. Thereby, it is possible to selectively move the casting pipe supported by the support member into a discharge position sealingly abutting against the vessel outlet and opening the outlet opening thereof. It also is possible, when it is desired to close the outlet opening, for example in an emergency situation, to selectively move the closing member supported by the support member to a closed position sealingly abutting against the vessel outlet and closing the outlet opening. In other words, when the apparatus is in the normal discharge position with the casting pipe in sealing abutment with the vessel outlet, when it then becomes desired to stop the discharge of molten metal, the moving means is operated to slide the casting pipe away from the discharge position thereof and simultaneously to slide the closing surface of the the closing member against the outlet and into the closing position with the closing surface blocking the outlet opening.

Preferably the closing surface is coplanar and coextensive with the upper or sealing surface of the casting pipe, such that during movement of the closing surface against the vessel nozzle the discharge of the molten metal is closed without interruption. This arrangement preferably is achieved by providing that the closing member has an edge adjacent the casting pipe that is shaped to encompass at least a portion of the periphery of the casting pipe, essentially in a so-called form-locking manner. Further preferably, the closing member is adjustable relative to the support member, both in opposite directions parallel to the discharge opening thereof and in opposite directions transverse to such discharge opening, i.e. toward and away from the casting pipe, to enable fine adjustment of the relative positions of the casting pipe and closing member.

Further preferably, the edge of the closing surface adjacent to the casting pipe is chamfered in the direction of the casting pipe, thereby making it possible to slide the closing member to the closing position below the vessel outlet without difficulty, for example without the edge of the closing member abutting the edge of the lower surface of the vessel outlet.

Further preferably, the closing member is made of metal, particularly copper, having good heat conducting properties. As a result, when the closing member is moved into the closing position, the molten metal cools so quickly within the outlet opening that the closing member will not be melted. This is important during an emergency closing operation. However, the closing member equally can be formed of a suitable refractory material that would be apparent to one skilled in the art.

In accordance with a further feature of the present invention, the support member supports two casting pipes that very quickly may be interchanged. The closing member is arranged between such two casting pipes and has respective edges encompassing the casting pipes over respective portions thereof at least equal to the width of the outlet opening.

BRIEF DESCRIPTION OF THE DRAWINGS

Other objects, features and advantages of the present invention will be apparent from the following detailed description of preferred embodiments thereof, with reference to the accompanying drawings, wherein.

DETAILED DESCRIPTION OF THE INVENTION

Figure 1:
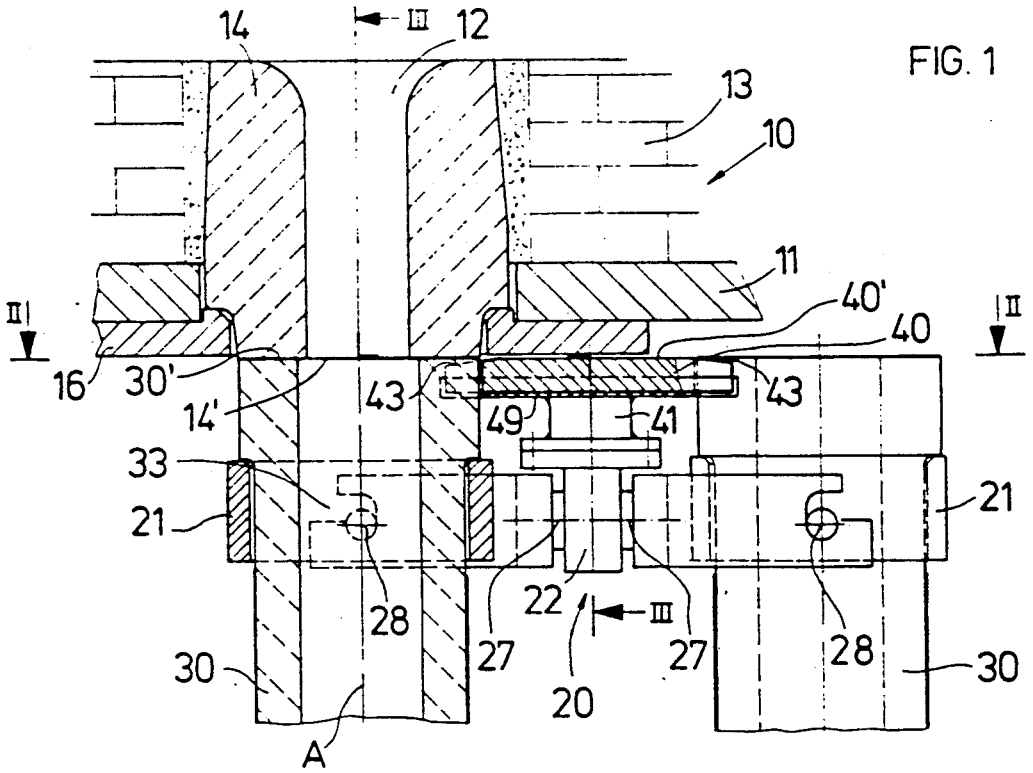
FIG. 1 is a partial longitudinal sectional view of an apparatus according to one embodiment of the present invention, shown in a position supporting a casting pipe beneath a nozzle of a metallurgical vessel.
Figure 2:
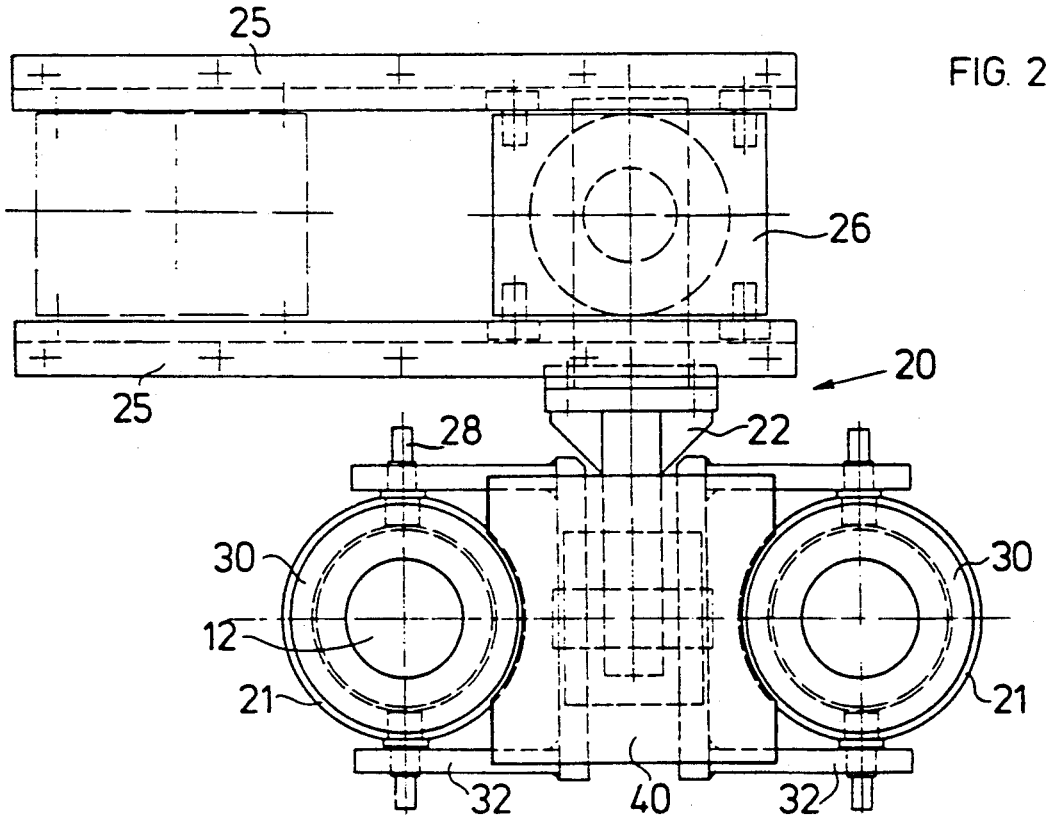
FIG. 2 is plan view taken along line II—II of FIG. 1.

Shown schematically in FIG. 1 is a portion of the bottom of a metallurgical vessel 10, the bottom including a conventional steel or other metal outer jacket 11, a refractory lining 13, and a vessel outlet in the form of a discharge sleeve 14 having therethrough an opening defining an outlet opening 12. Refractory discharge sleeve 14 is embedded in refractory lining 13 and is positioned by a centering plate 16 attached to jacket 11.

The apparatus of the present invention is shown in operative position with respect to a bottom surface 14' of sleeve 14. This is a so-called free-running nozzle outlet. It is to be understood however that the present invention equally would be applicable to an arrangement whereby the outlet opening is provided with a conventional stopper. It equally is understood that the apparatus of the present invention could be positioned for a cooperative mounting to an outlet defined in a plate of a conventional slide plate or slide enclosure unit.

The apparatus 20 of the present invention supports a pair of refractory casting pipes 30. Particularly, one casting pipe 30 is mounted in the position shown in FIG. 1 with an upper end face 30' thereof in sealing abutment with lower surface 14' of nozzle outlet 14, such that molten metal may be discharged downwardly. Although the apparatus 20 as illustrated supports two casting pipes 30, the apparatus may be structured to support only a single casting pipe, or even more than two casting pipes.

The apparatus 20 includes a support member 22 in the form of, for example, a bearing arm. Support member 22 is supported by a piston/cylinder unit 24, for example by a rigid connection between support member 22 and a piston rod 29 of unit 24. Accordingly, upon operation of unit 24, support member 22 may be moved in opposite directions parallel to longitudinal axis A of outlet opening 12. Unit 24 is mounted on a trolley 26 that is longitudinally slidable along tracks or rails 25 mounted beneath the metallurgical vessel and extending in directions transverse or orthogonal to axis A. Thus, trolley 26 and thereby unit 24 and support member 22 may be moved, for example by means not illustrated but that would be understood by one skilled in the art, in opposite directions transverse to axis A, i.e. parallel to the plane of FIG. 1 and transverse to the plane of FIG. 3 of the drawings.

Support member 22 supports on opposite sides thereof a pair of fork members 32 that are spaced from each other in a direction parallel to tracks 25. Each fork member is pivotable about a respective axis 27. Supported in recesses 33 of the arms of each fork member 32 is a respective support ring 21 that supports a respective casting pipe 30. Each ring 21 is pivotable with respect to its fork member 32 about an axis 28 extending transverse to axis 27. The two axes 27, 28 thus define a type of cardan joint suspension that enables each casting pipe 30 to be articulated in a manner to compensate for any differences in parallel alignment between respective faces 30' and 14'.

Mounted on support member 22 at a position to be between the two casting pipes 30 is a closing member 40 having an upper closing surface 40' that extends laterally of, and preferably coplanar with, surfaces 30' of casting pipes 30. In the illustrated arrangement, closing member 40 is essentially plate-shaped but could be of other shapes such as block-shaped. Closing member 40 is removably and adjustably mounted on support member 22 to be adjustable horizontally and/or vertically with respect thereto. For example, as illustrated closing member 40 is mounted within a frame 49, e.g. clamped therein. Frame 49 is attached to a base member 41 that may be threaded to support member 22 or connected thereto in a manner to enable relative horizontal and/or vertical adjustment therebetween. Thus, base 41 could be adjusted vertically with respect to support member 22 by the insertion therebetween of spacers. By such adjustment it is possible to align faces 30' and 14' to be coplanar. Additionally, member 40 can have an edge thereof shaped to receive or encompass a portion of the circumference of pipe 30 at least over a portion equal to or greater than the width of opening 12. Thereby, and additionally by horizontal adjustment of member 40 relative to pipe 30 it is possible to insure a continuous surface formed by surfaces 30' and 40'. Thereby, when the apparatus is moved from the position shown in FIG. 1 leftwardly relative thereto, surface 40' will slide across surface 14' to a closing position sealingly in abutment with surface 14' and closing opening 12. To avoid the edge of surface 40' abutting against discharge sleeve 14, the edges of member 40 confronting the respective pipes 30 may be chamfered as shown at 43. Such angle of chamfering may be approximately 5° to 30°.

Closing member 40 can be made of metal, for example copper or also can be made of a suitable refractory material that, as would be understood by one skilled in the art, would have sufficient heat conducting properties such that when the member 40 is moved to the closing position, the molten metal very quickly would be cooled sufficiently to freeze and not melt member 40. Advantageously, the dimensions of closing surface 40' match approximately those of face 14' of discharge sleeve 14.

If, during casting of molten metal such as steel, for any reason such casting must be interrupted, support member 22 simply is moved, either manually or by means of a not illustrated drive, such that closing member 40 is slid against surface 14' and closes opening 12. This sliding movement could be achieved with the existing contact pressure exerted by the apparatus between surfaces 30'/40' against surface 14'. Such contact pressure, to achieve necessary sealing, could be achieved by operation of piston/cylinder unit 24 operating upwardly with respect to FIGS. 1 and 3.

As indicated above, the illustrated apparatus supports two casting pipes 30. Such device permits not only the mounting of a casting pipe in the required discharge position, but also makes it possible to very rapidly replace casting pipes when this becomes necessary. This could be achieved simply by a continuous movement of the apparatus leftwardly relative to the illustration of FIG. 1 from the illustrated position to a position in which the right casting pipe then is below discharge nozzle 14. Such replacement could be achieved by relatively quick sliding movement during discharge of the molten metal without any significant interruption of the discharge. It is to be understood that it is contemplated that the required sealing pressure of surfaces 30' or 40' against surface 14' is achieved by operation of unit 24 to press surfaces 30' or 40' upwardly against surface 14'. On the other hand, exchange of pipes 30 or positioning of member 40 in sealing contact with surface 14' could be achieved by sliding the apparatus in the directions parallel to tracks 25. Positioning of course also could be achieved by combined operation of unit 24 and movement along tracks 25. The casting pipe or the closing member can be forced against sleeve 14 by a determined contact pressure by operation of unit 24. As illustrated, trolley 26 moves by means of four wheels along tracks 25, but such movement could be achieved by other means. It further is to be understood that the support member 22 could be mounted on a fixed support adjacent the nozzle outlet, rather than by being mounted on the bottom of the metallurgical vessel itself.

Figure 3:
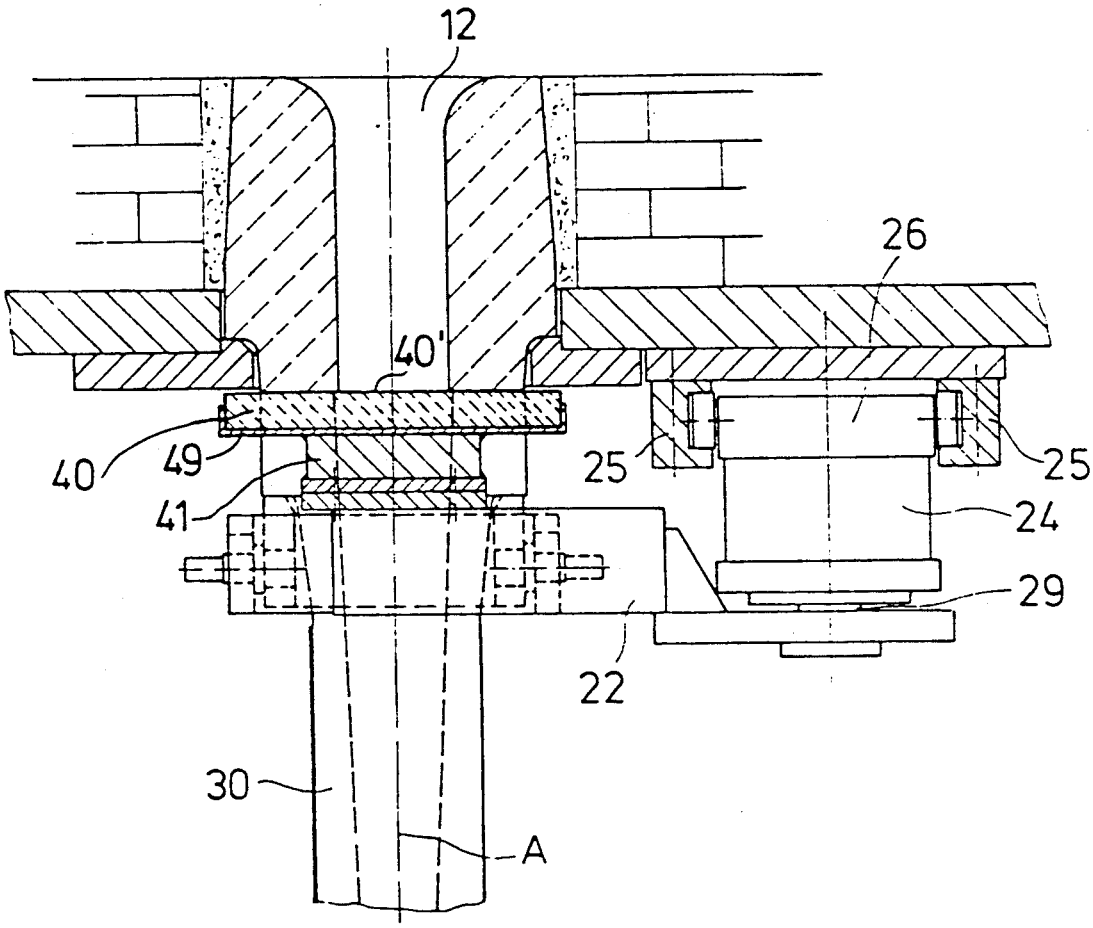
FIG. 3 is a transverse cross-sectional view taken along line III—III of FIG. 1.

In the arrangement of FIG. 1, the closing member 40 is formed of a metal material, but in the embodiment shown in FIG. 3 the member 40 is illustrated as being of refractory material. In either case it is contemplated that the member 40 be inserted in and held for example by clamping or screwing, in frame member 49 preferably of metal.

Figure 4:
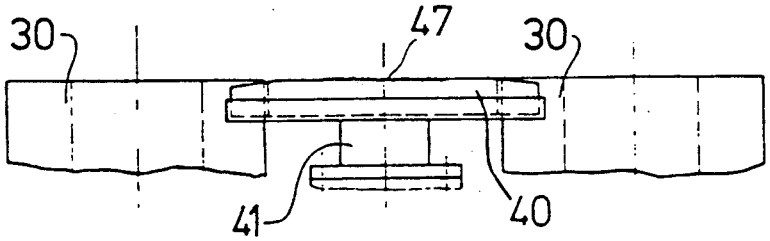
FIG. 4 is a partial view of a modified embodiment of a closing member according to the present invention.

FIG. 4 illustrates an additional feature of the present invention wherein the closing surface of member 40 is roughened, at least partially, as shown at 47. In accordance with this feature, when the apparatus is moved to position the member 40 against surface 14', roughened closing surface 47 rubs against and cleans the bottom of surface 14' of discharge sleeve 14. This improves the seal between such surfaces. Particularly, when a casting pipe 30 is moved or replaced, roughened surface 47 can operate to clean bottom surface 14' such that there is guaranteed a good seal between surface 14' and the casting pipe subsequently moved thereagainst.

Although the present invention has been described and illustrated with respect to preferred features thereof, it is to be understood that various changes and modifications may be made to the specifically described and illustrated features without departing from the scope of the present invention.

I claim:

1. An apparatus for mounting a casting pipe, having a discharge opening formed therethrough, to an outlet of a metallurgical vessel to enable discharge of molten metal from the vessel through an opening of the outlet and through the discharge opening of the casting pipe, said apparatus comprising:

a support member having means for supporting at least one casting pipe;

means for mounting said support member at a position adjacent the outlet of the vessel;

a separate closing member mounted on said support member in a manner such that a closing surface of said closing member is at a position to extend from a periphery of an upper end surface of the casting pipe supported by said support member to a position offset laterally from the periphery of the upper end surface of the casting pipe supported by said support member; and means for adjustably moving said support member, and thus the casting pipe supported thereby and said closing member, relative to the outlet in first opposite directions to be parallel to a longitudinal axis of the outlet opening and in second opposite directions transverse said first opposite directions and to be transverse to the longitudinal axis, and thereby for selectively moving the casting pipe supported by said support member into a discharge position sealingly against the outlet and opening the outlet opening, and for selectively moving said closing member supported by said support member to a closed position sealingly against the outlet and closing the outlet opening.

2. An apparatus as claimed in claim 1, wherein said closing member is mounted on said support member for adjustment relative thereto in said first opposite directions and in said second opposed directions.

3. An apparatus as claimed in claim 1, wherein said closing surface, at an edge thereof to be directed toward the casting pipe, is chamfered.

4. An apparatus as claimed in claim 1, wherein said closing member is formed of metal.

5. An apparatus as claimed in claim 4, wherein said closing member is formed of copper.

6. An apparatus as claimed in claim 1, wherein at least said closing surface of said closing member is formed of refractory material.

7. An apparatus as claimed in claim 6, wherein said closing member is entirely formed of refractory material.

8. An apparatus as claimed in claim 1, wherein said closing surface of said closing member is roughened, thereby forming means for cleaning the end face of the outlet upon said closing surface being moved into sealing contact therewith.

9. An apparatus as claimed in claim 1, wherein said closing member has an edge shaped to encompass the casting pipe over a portion thereof at least equal to the width of the discharge opening.

10. An apparatus as claimed in claim 1, wherein said support member includes means for supporting two casting pipes at positions spaced from each other in said second opposite directions.

11. An apparatus as claimed in claim 10, wherein said closing member is supported by said support member at a position to be between the two casting pipes.

12. An apparatus as claimed in claim 11, wherein said closing member has opposite edges shaped to encompass respective of the two casting pipes over portions thereof at least equal to the width of the discharge opening.

13. An apparatus as claimed in claim 1, wherein said closing member is positioned within a frame member.

14. An apparatus as claimed in claim 13, wherein said frame member is attached to a base member that is detachably connected to said support member.

15. An apparatus as claimed in claim 14, wherein said base member is adjustable relative to said support member in said first opposite directions and in said second opposite directions.

16. An apparatus as claimed in claim 1, wherein said moving means comprise a piston/cylinder unit connected to said support member, such that operation of said piston/cylinder unit moves said support member in said first opposite directions.

17. An apparatus as claimed in claim 16, wherein said moving means further comprises tracks extending in said second opposite directions, with said piston/cylinder unit being mounted for movement along said tracks.

18. An apparatus as claimed in claim 1, wherein said supporting means comprises a fork member connected to said support member for pivotal movement about a first axis, and a ring member for receiving the casting pipe and mounted on said fork member for pivotal movement about a second axis transverse to said first axis.

19. An apparatus as claimed in claim 1, wherein said closing member is mounted on said support member in a manner such that said closing surface of said closing member is at a position to extend substantially coplanar with the upper end surface of the casting pipe supported by said support member.

* * * * *